US008585467B2

(12) United States Patent
Brown et al.

(10) Patent No.: US 8,585,467 B2
(45) Date of Patent: Nov. 19, 2013

(54) LINEAR PRESSURE FEED GRINDING WITH VOICE COIL

(75) Inventors: James William Brown, Painted Post, NY (US); Babak Robert Raj, Elmira, NY (US)

(73) Assignee: Corning Incorporated, Corning, NY (US)

( * ) Notice: Subject to any disclaimer, the term of this patent is extended or adjusted under 35 U.S.C. 154(b) by 872 days.

(21) Appl. No.: 12/582,103

(22) Filed: Oct. 20, 2009

(65) Prior Publication Data

US 2010/0112910 A1 May 6, 2010

Related U.S. Application Data

(60) Provisional application No. 61/110,184, filed on Oct. 31, 2008.

(51) Int. Cl.
*B24B 7/24* (2006.01)
*B24B 7/07* (2006.01)

(52) U.S. Cl.
USPC ..... 451/178; 451/44; 451/388; 451/412

(58) Field of Classification Search
USPC ..... 451/5, 11, 21, 43, 44, 178, 260, 282, 451/331, 388, 412
See application file for complete search history.

(56) References Cited

U.S. PATENT DOCUMENTS

| | | | | |
|---|---|---|---|---|
| 3,030,744 | A * | 4/1962 | Mueller | 451/374 |
| 4,493,166 | A * | 1/1985 | Lange et al. | 451/237 |
| 4,575,970 | A * | 3/1986 | Kozai et al. | 451/26 |
| 5,143,196 | A | 9/1992 | Henn et al. | 198/345.3 |
| 5,146,715 | A * | 9/1992 | Bando | 451/11 |
| 5,148,632 | A | 9/1992 | Adler et al. | 51/55 |
| 5,423,717 | A | 6/1995 | Boaz | 451/449 |
| 5,655,956 | A | 8/1997 | Ferreira et al. | 451/143 |
| 6,099,385 | A | 8/2000 | Stock et al. | 451/8 |
| 6,196,902 | B1 | 3/2001 | Gazca-Ortiz et al. | 451/242 |
| 6,216,491 | B1 | 4/2001 | Fehlner | 65/25.3 |
| 6,325,704 | B1 | 12/2001 | Brown et al. | 451/44 |
| 6,428,390 | B1 | 8/2002 | Clark et al. | 451/11 |
| 7,018,272 | B2 * | 3/2006 | Allaire et al. | 451/11 |
| 7,207,866 | B2 * | 4/2007 | Allaire et al. | 451/41 |
| 2005/0026541 | A1 * | 2/2005 | Allaire et al. | 451/5 |
| 2006/0121832 | A1 * | 6/2006 | Allaire et al. | 451/11 |

FOREIGN PATENT DOCUMENTS

| | | |
|---|---|---|
| EP | 0 601 748 A1 | 11/1993 |
| JP | 05-092362 A | 4/1993 |
| JP | 07-060626 A | 3/1995 |

* cited by examiner

*Primary Examiner* — Timothy V Eley
(74) *Attorney, Agent, or Firm* — Matthew J. Mason; William J. Tucker

(57) ABSTRACT

The present invention is directed to an apparatus for grinding or polishing at least one edge of a glass substrate. The apparatus includes a grinding unit configured to remove a predetermined amount of material from the edge when in an aligned position. The grinding unit applies a predetermined force normal to the edge. An air bearing slide system is coupled to the grinding unit. The air bearing slide system is configured to slide along a predetermined axis on a thin film of pressurized air that provides a zero friction load bearing interface. A linear actuation motor is coupled to the air bearing slide system. The linear actuation motor is configured to control the movement of the air bearing slide system such that the grinding unit is moved from a non-aligned position to the aligned position.

15 Claims, 5 Drawing Sheets

LINEAR PRESSURE FEED GRINDING WITH VOICE COIL

CROSS-REFERENCE TO RELATED APPLICATION

This application claims the benefit of priority to U.S. Provisional Application No. 61/110,184 filed on Oct. 31, 2008 and entitled "LINEAR PRESSURE FEED GRINDING WITH VOICE COIL," the content of which is incorporated herein by reference in its entirety.

TECHNICAL FIELD

The present invention relates generally to display glass substrates, and particularly to a system for edge finishing glass substrates.

BACKGROUND

The manufacturing process of flat panel display substrates requires specific sized glass substrates capable of being processed in standard production equipment. To obtain substrates having the proper size, mechanical scoring and breaking processes, or a laser scoring techniques are employed. Each of these sizing methods requires edge finishing. The finishing process involves grinding and/or polishing the edges to remove sharp edges and other defects that may degrade the strength and durability of the substrate. Furthermore, there are many processing steps that require handling in the manufacturing of an LCD panel. Thus, glass substrates used for Liquid Crystal Displays (LCD) require an edge that is sufficiently durable for mechanical handling and contact.

The finished edges are created by grinding the unfinished edge with an abrasive metal grinding wheel. In conventional systems, the glass substrate is disposed on a chuck and advanced through a series of grinding positions. Each position is equipped with a different abrasive grinding wheel based on the coarseness/fineness of the grit disposed on the wheel. The finishing process is complete after the glass substrate traverses each grinding position. However, when the glass is not properly aligned relative to the grinding wheel, the quality of the finished glass substrate is degraded. In particular, glass misalignment can adversely impact the dimensional accuracy of the glass. Second, glass misalignment may cause inferior edge quality, which usually results in a substrate of inferior strength. Accordingly, substrate breakage may occur during LCD processing steps. Further exacerbating the problems discussed above, is the demand for larger and larger display sizes. This demand, and the benefits derived from economies of scale, are driving AMLCD manufacturers to process larger display substrates. It is therefore critical that larger display substrates are provided having the requisite edge quality, dimensional accuracy, and strength.

There are three approaches that are being considered to address the above stated issues. In one approach, substrate manufacturers are evaluating grinding systems that offer improved alignment accuracy. Unfortunately, since LCD manufacturers are using larger and larger substrates, alignment tolerances become much more critical when the size of the substrate increases. Accurate alignment is more of a necessity because small skew angles translate into larger errors when larger substrates are being processed. One drawback to this approach relates to the fact that while alignment tools may be acquired having the requisite precision, the accuracy cannot be maintained over time due to wear.

In another approach that has been considered, grinding systems may be employed that compensate for lack of alignment accuracy by removing more material. Typically, edge finishing grinding systems need only remove approximately 100 microns of material. The concept is to provide a larger substrate and remove the right amount of material to meet dimensional requirements. One way to accomplish this is to use a system that includes multiple grinding steps. This translates into more grinding spindles and more grinding wheels. One drawback to this approach is the capital expense of the additional processing equipment. Further, once the equipment is obtained, more equipment requires more maintenance. Another way to remove more material is to employ coarser grinding wheels. Unfortunately, this option is not attractive because a rougher finish has a greater propensity for substrate breakage.

Yet another way to remove more material is to reduce the speed at which substrates traverse the finishing system. Unfortunately, this approach reduces production capacity and the ground edge quality. Further, increased capital expenditures would be required if the production volume is to be maintained.

In yet another approach that has been considered, a self-aligning grinding system may be used that tracks the substrate edge. The pressure feed grinding approach applies a predetermined force normal to the edge of the substrate. The grinding wheel moves, or tracks, with the instantaneous position of the edge by rotating about a pivot element. Because grinding wheel position is determined by the position of the substrate edge, the resultant substrate product has improved dimensional accuracy, relative to conventionally ground substrates. Unfortunately, there is a drawback to this technique as well. The cylindrical pivot employed in conventional pressure feed systems includes mechanical bearings. In order to overcome the frictional force of these mechanical bearings, a normal force of approximately 16N must be applied. This force exceeds the strength of the glass substrate and breakage will occur if that force is applied. While the pressure feed grinding approach appears to be promising, it cannot be employed unless the aforementioned problems are overcome.

In light of the foregoing, it is desirable to provide an edge finishing apparatus that is configured to remove a precise amount of glass and yet maintain the edge quality. It is also desirable to provide an edge finishing apparatus having improved dimensional accuracy. Furthermore, the edge finishing apparatus should finish the edge of a glass in a timely manner without degrading the desired strength and edge quality attributes of the glass. What is needed is a pressure feed grinding apparatus that provides the above described features while overcoming the limitations of conventional pressure feed grinding systems discussed above.

SUMMARY OF THE INVENTION

The present invention addresses the needs described above. The pressure feed grinding apparatus of the present invention provides a frictionless system that overcomes the limitations of conventional pressure feed grinding systems. The present invention provides an edge finishing apparatus that is configured to remove a precise amount of glass. As such, the dimensions of glass substrates finished by the present invention is much closer to the dimensions of the sheet as received when compared to glass substrates finished by conventional systems. Further, the present invention provides finished glass substrates that have comparable strength and edge quality.

One aspect of the present invention is an apparatus for grinding or polishing at least one edge of a glass substrate.

The apparatus includes a grinding unit configured to remove a predetermined amount of material from the at least one edge when in an aligned position. An air bearing slide system is coupled to the grinding unit. The air bearing slide system is configured to slide along a predetermined axis on a thin film of pressurized air that provides a zero friction load bearing interface. A linear actuation motor is coupled to the air bearing slide system. The linear actuation motor is configured to control the movement of the air bearing slide system such that the grinding unit is moved from a non-aligned position to the aligned position. The grinding unit applies a predetermined force normal to the at least one edge. The predetermined force being directly proportional to the predetermined amount and less than a normal force resulting in glass substrate breakage.

In another aspect, the present invention includes a method for grinding or polishing at least one edge of a glass substrate. The method includes the step of providing an air bearing slide system configured to slide along a predetermined axis on a thin film of pressurized air that provides a zero friction load bearing interface. A grinding unit is coupled to the air bearing slide system. The grinding unit is configured to remove a predetermined amount of material from the at least one edge when in an aligned position. A movement of the air bearing slide system is controlled such that the grinding wheel is moved from a non-aligned position to the aligned position. A predetermined force is applied normal to the at least one edge. The predetermined force is directly proportional to the predetermined amount and less than a normal force resulting in glass substrate breakage. The glass substrate is moved in a tangential direction relative to the grinding unit to remove the predetermined amount of material from the at least one edge. As an alternative, the sheet of glass may be held stationary while the grinding unit is moved along the edge of glass being finished.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description are merely exemplary of the invention, and are intended to provide an overview or framework for understanding the nature and character of the invention as it is claimed. The accompanying drawings are included to provide a further understanding of the invention, and are incorporated in and constitute a part of this specification. The drawings illustrate various embodiments of the invention, and together with the description serve to explain the principles and operation of the invention.

DETAILED DESCRIPTION

Figure 1:
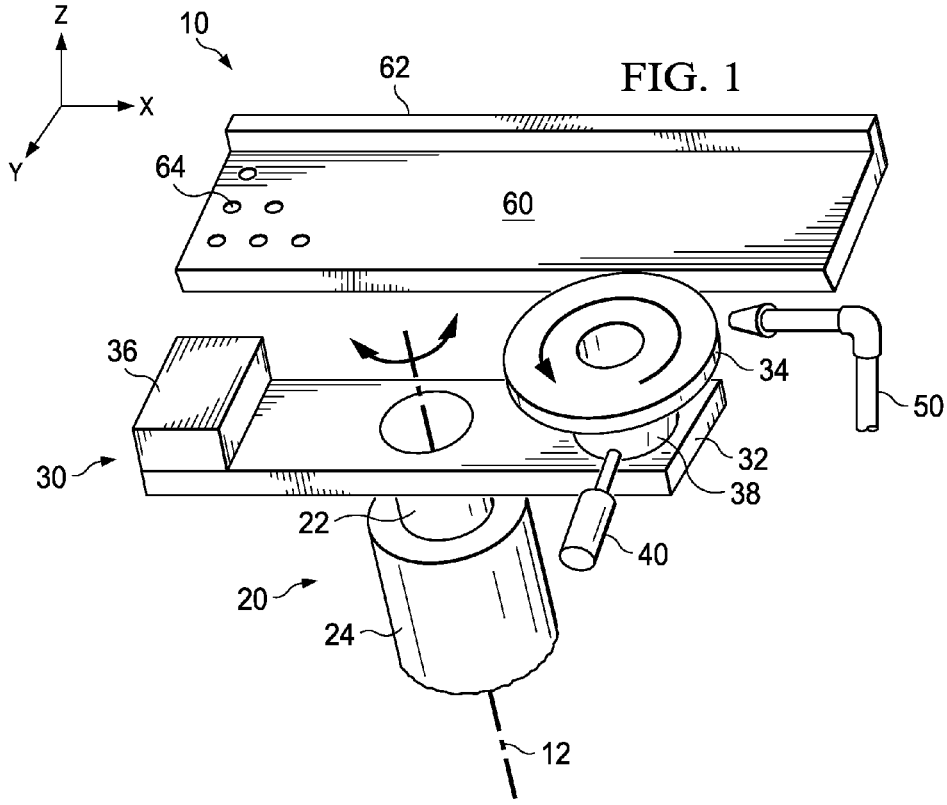
FIG. 1 is a perspective view of the pressure feed grinding system in accordance with the present invention.

Reference will now be made in detail to the present exemplary embodiments of the invention, examples of which are illustrated in the accompanying drawings. Wherever possible, the same reference numbers will be used throughout the drawings to refer to the same or like parts. An exemplary embodiment of the apparatus of the present invention is shown in FIG. 1, and is designated generally throughout by reference numeral 10.

In accordance with the invention, the present invention is directed to an apparatus for grinding or polishing at least one edge of a glass substrate. The apparatus includes a grinding unit configured to remove a predetermined amount of material from the at least one edge when in an aligned position. An air bearing slide system is coupled to the grinding unit. The air bearing slide system is configured to slide along a predetermined axis on a thin film of pressurized air that provides a zero friction load bearing interface. A linear actuation motor is coupled to the air bearing slide system. The linear actuation motor is configured to control the movement of the air bearing slide system such that the grinding unit is moved from a non-aligned position to the aligned position. The grinding unit applies a predetermined force normal to the at least one edge. The predetermined force being directly proportional to the predetermined amount and less than a normal force resulting in glass substrate breakage.

Thus, the pressure feed grinding apparatus of the present invention overcomes the limitations of conventional pressure feed grinding systems. The present invention provides an edge finishing apparatus that is configured to remove a minimum amount of glass. As such, the dimensional accuracy of glass substrates finished by the present invention is much closer to the dimension of the original sheet (as received) relative to glass substrates finished by conventional systems. Further, the present invention provides finished glass substrates that have comparable strength and edge quality to that of traditional fixed grinding process.

As embodied herein, and depicted in FIG. 1, a perspective view of the pressure feed grinding system 10 in accordance with the present invention is disclosed. System 10 includes air bearing support structure 20 coupled to grinding unit 30. Air bearing support structure 20 includes air bearing cylinder 22 disposed within stationary housing 24. Air bearing cylinder 22 is coupled to support platform 32. As shown, support platform 32 tends to pivot about the longitudinal axis 12 of cylinder 22. Thus, the longitudinal axis 12 of cylinder 22 functions as an axis of rotation for grinding unit 30. Air bearing motor 38 is disposed on one end of support member 32. The air bearing motor 38 is configured to drive grinding wheel 34. Pneumatic cylinder 40 is coupled to motor 38 and is configured to apply a predetermined force in a direction that is normal to the edge of a glass substrate being finished by system 10. Counter-weight 36 is disposed on the end of support 32 that is opposite motor 38 and grinding wheel 34. Those of ordinary skill in the art will recognize that counter-weight 36 balances the weight of the grinding unit 30 in the z-direction. Conveyor vacuum chuck 60 is disposed proximate grinding wheel 34. Vacuum chuck 60 includes a raised edge 62 that is used to register the glass substrate. Vacuum chuck 60 includes a plurality of holes 64 which are in communication with a vacuum source. Because the grinding/ polishing operations generate heat, system 10 also provides coolant nozzle 50 at the location where grinding wheel 34 interfaces vacuum chuck 60 and the glass substrate.

Air bearing support structure 20 may be of any suitable type, as long as there is zero frictional resistance opposing the pivotal movement about axis 12. In one embodiment, air bearing support structure 20 is of a type manufactured by New Way Machine Components, Inc. In the present invention, air bearing cylinder 22 is supported by a thin film of pressurized air that provides a zero friction load bearing interface between surfaces that would otherwise be in contact with each other. The thin film air bearing is generated by supplying a flow of air through the bearing itself to the bearing surface. Unlike traditional 'orifice' air bearings, the air bearing of the present invention delivers air through a porous medium to ensure uniform pressure across the entire bearing area. Although the air constantly dissipates from the bearing site, the continual flow of pressurized air through the bearing is sufficient to support the working loads.

The use of a pressure feed grinding system is made possible by the zero static friction air bearing. As discussed above in the background section, a normal force of approximately 16N must be applied to overcome the frictional force of conventional mechanical bearings. This force exceeds the strength of the glass substrate. Because of zero static friction, infinite resolution and very high repeatability are possible. For example, because the normal force applied to grinding wheel 34 does not have to overcome any frictional force, the applied normal force is substantially proportional to the amount of material that is removed (chuck speed being constant). The inventors of the present invention have determined that under typical system settings, every 1N applied translates to 25 microns of material removed. The normal force applied to the edge is typically within the range between 1N-6N. This translates to the removal of an amount of material in a range between 25-150 microns. In a typical application, a 4N force is applied, resulting in the removal of approximately 100 microns of material. Thus, the zero friction air bearing support 20 of the present invention offers distinct advantages in dimensional accuracy and precision positioning. There are other features and benefits associated with zero static friction air bearings.

Because a zero static friction air bearing is also a non-contact bearing, there is virtually zero wear. This results in consistent machine performance and low particle generation. Further, non-contact air bearings avoid the conventional bearing-related problem of lubricant handling. Simply put, air bearings do not use oil lubrication. Accordingly, the problems associated with oil are eliminated. In dusty environments (dry machining) air bearings are self-cleaning because the aforementioned positive air pressure generated by the air flow removes any ambient dust particles. In contrast, conventional oil-lubricated bearings are compromised when the ambient dust mixes with the lubricant to become a lapping slurry.

Figure 2:
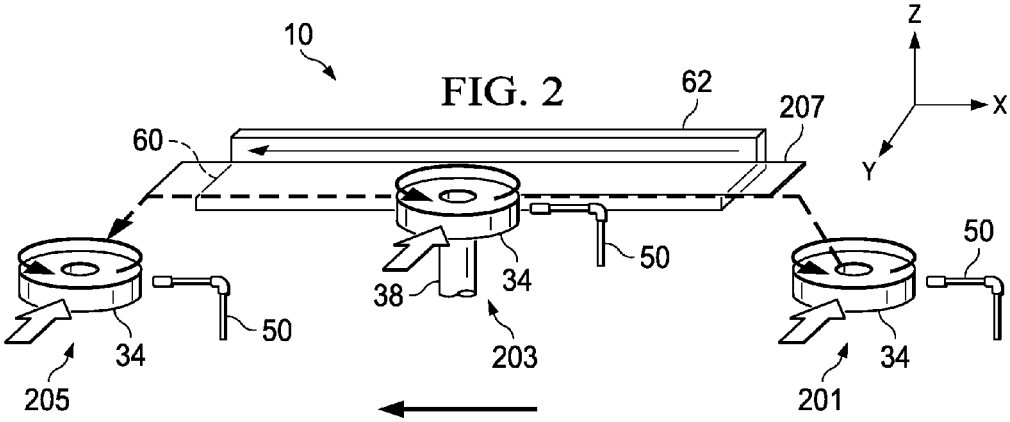
FIG. 2 shows the pressure feed grinding system depicted in FIG. 1 in operation.

Referring to FIG. 2, the pressure feed grinding system 10 is shown in operation. First, the glass substrate 207 is placed on vacuum conveyor 60 in registration with raised edge 62. A vacuum is applied to hold the glass substrate 207 in place during the edge finishing operation. In this example, the size of the glass substrate 207 is approximately 457 mm×76 mm×0.7 mm. The angular velocity of the grinding wheel 34 is substantially equal to 5,000 rpm. Grinding wheel 34 is disposed at the leading edge of the substrate at the initial position 201, and a normal force of 4N is applied by pneumatic cylinder 40 (not shown). The glass substrate 207 is linearly advanced in the tangential direction by vacuum chuck 60 at a rate of approximately 5 meters/minute. At the conclusion of the grinding/polishing operation, when grinding wheel 34 passes the trailing edge of the glass substrate 207, the 4N normal force is relaxed and grinding wheel 34 is removed from the edge of the glass substrate 207. Approximately 100 microns of material has been uniformly removed from the edge along the entire length of the glass substrate 207. It is noted that FIG. 2 is not to scale, the maximum distance that air bearing support 20 can move when moving from the initial position 201 to the grinding position 203, or from the grinding position 203 to the end position 205, is approximately 1 mm.

FIGS. 3A-4B are examples illustrating the edge tracking capabilities of the present invention. Edge tracking refers to the position of grinding wheel 34 relative to the glass substrate 207 as it moves from the leading edge "L" to the trailing edge "T". The ability to track the edge is one of the advantages of a pressure feed system. This feature obviates the alignment issues present in conventional systems. Because the air bearing spindle 20 is frictionless, it allows grinding unit 34 to track the edge of the glass substrate 207 in spite of a skewed glass substrate 207. FIGS. 3A-4B represent experiments performed to verify the edge tracking capabilities of the present invention.

Figure 3A:
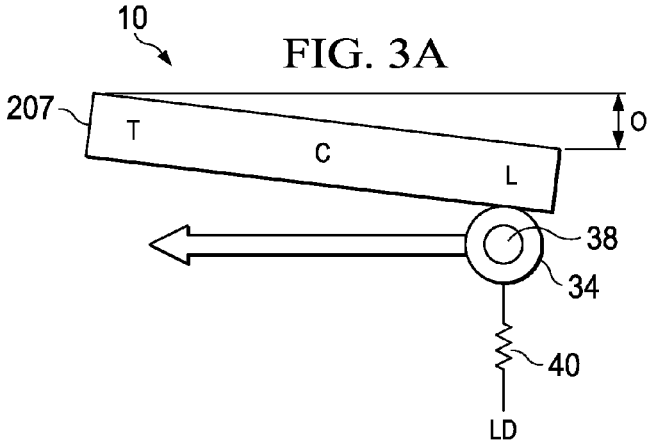
FIG. 3A is a schematic of the pressure feed grinding system in plan view showing a glass substrate having a skewed leading edge.
Figure 3B:
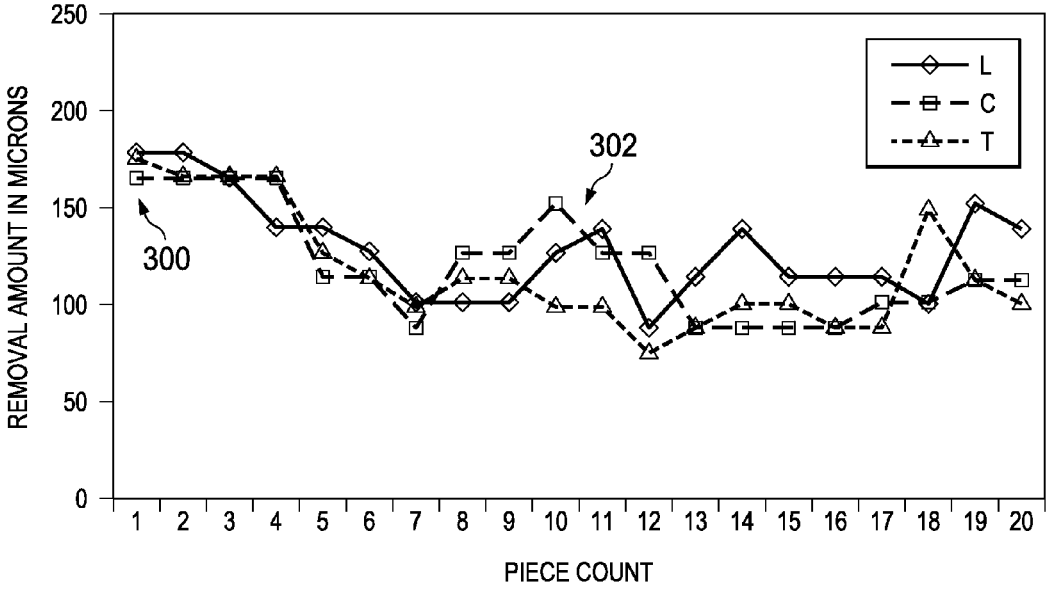
FIG. 3B is a chart showing the edge tracking performance of the arrangement depicted in FIG. 3A.

Referring to FIG. 3A, a schematic of system 10 in plan view shows a glass substrate 207 having a skewed leading edge. In this example, load cylinder 40 applies a 3.5N force normal to the substrate edge. The glass substrate 207 is skewed by offsetting "O" the leading edge "L" by 300 microns. FIG. 3B is a chart showing the edge tracking performance of the arrangement depicted in FIG. 3A. FIG. 3B plots the performance of system 10 for twenty substrate pieces. Referring to data points 300, which represents the first glass substrate 207 processed, the system 10 removes substantially the same amount of material from both the leading edge "L" and the trailing edge "T". System 10 removes approximately 10 microns less from the center portion "C" of the glass substrate 207. While there are some deviations (See data points 302), the system 10 tracks the edge of the glass substrate 207 remarkably well. It is noted that the amount of material removed decreases after repeated uses. This most likely due to the wear on grinding wheel 34.

Figure 4A:
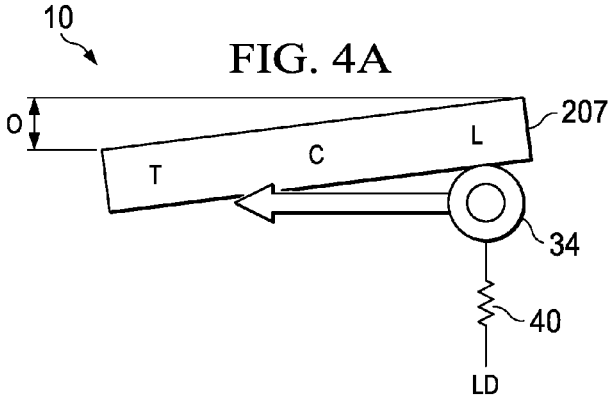
FIG. 4A is a schematic of the pressure feed grinding system in plan view showing a glass substrate having a skewed trailing edge.
Figure 4B:
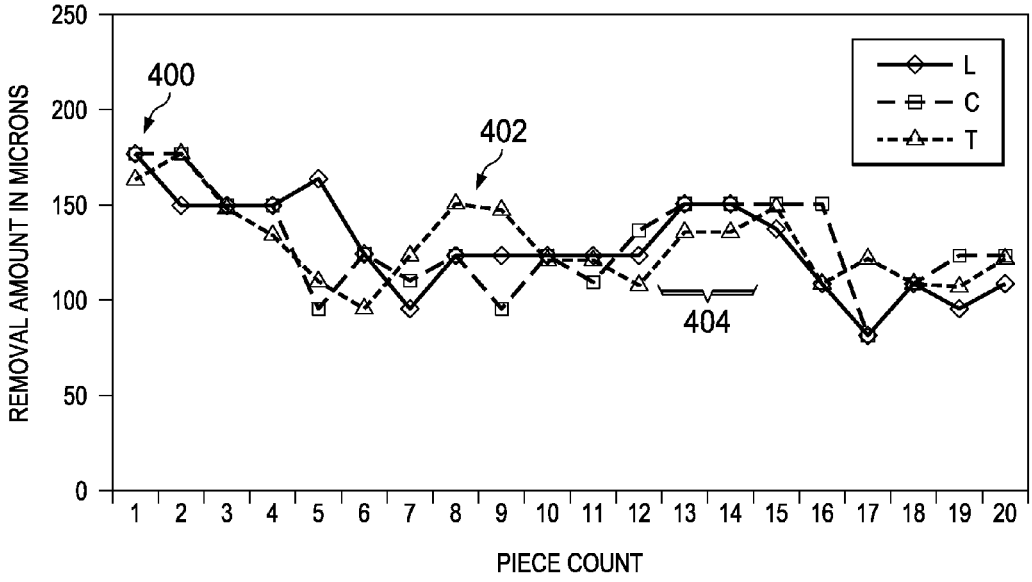
FIG. 4B is a chart showing the edge tracking performance of the arrangement depicted in FIG. 4A.

FIG. 4A is also a schematic of system 10 in plan view. This diagram shows a glass substrate 207 having a skewed trailing edge. However, in this experiment the glass substrate 207 is skewed by offsetting "O" the trailing edge "T" by 300 microns. Again, load cylinder 40 applies a 3.5N force normal to the substrate edge. FIG. 4B is a chart showing the edge tracking performance of the arrangement depicted in FIG. 4A. FIG. 4B plots the performance of the system 10 for twenty substrate pieces. Referring to data points 400, which represents the first glass substrate 207 processed, the system 10 removes substantially the same amount of material from both the leading edge "L" and the center edge "C" portion. System 10 removes approximately 10 microns less from the trailing edge "T" of the glass substrate 207. Referring to data points 402, there are some tracking deviations present. However, as evidenced by data points 404, the difference in the amount of material removed from the various edges "L", "T", "C" of the glass substrate 207 is typically in the 10-15 micron range. The applied force is not the only factor at determining the amount of glass removal achieved during grinding. The condition of the grinding wheel 34 surface also has a significant impact on the amount of material that is removed. Referring to FIG. 3B and FIG. 4B, the effective life span of grinding wheel 34 is a factor in the removal rate of the edge grinding system 10.

The standard grinding procedure used in conventional systems facilities is to dress the grinding wheel and grind to a fixed position to thereby ensure that the targeted size is met. During this process, the normal load will increase to a point that will require the wheel to be redressed to allow for further grinding. If the wheel is not dressed at a reasonable load, the grinding wheel will create defects in the glass. Typically, these defects are chipping and burning defects. These defects occur when the diamond particles in the wheel are not sufficiently sharp enough to remove the desired amount of material. On the other hand, one advantage of the present invention is that chipping and burning defects will not occur when using pressure feed type of grinding because, as explained above, the set normal force is always lower than the amount of force required to create these defects. The concern with pressure feed grinding is that as the grinding wheel 34 ages the removal rate diminishes to a point where an insufficient amount of material is removed.

Figure 5:
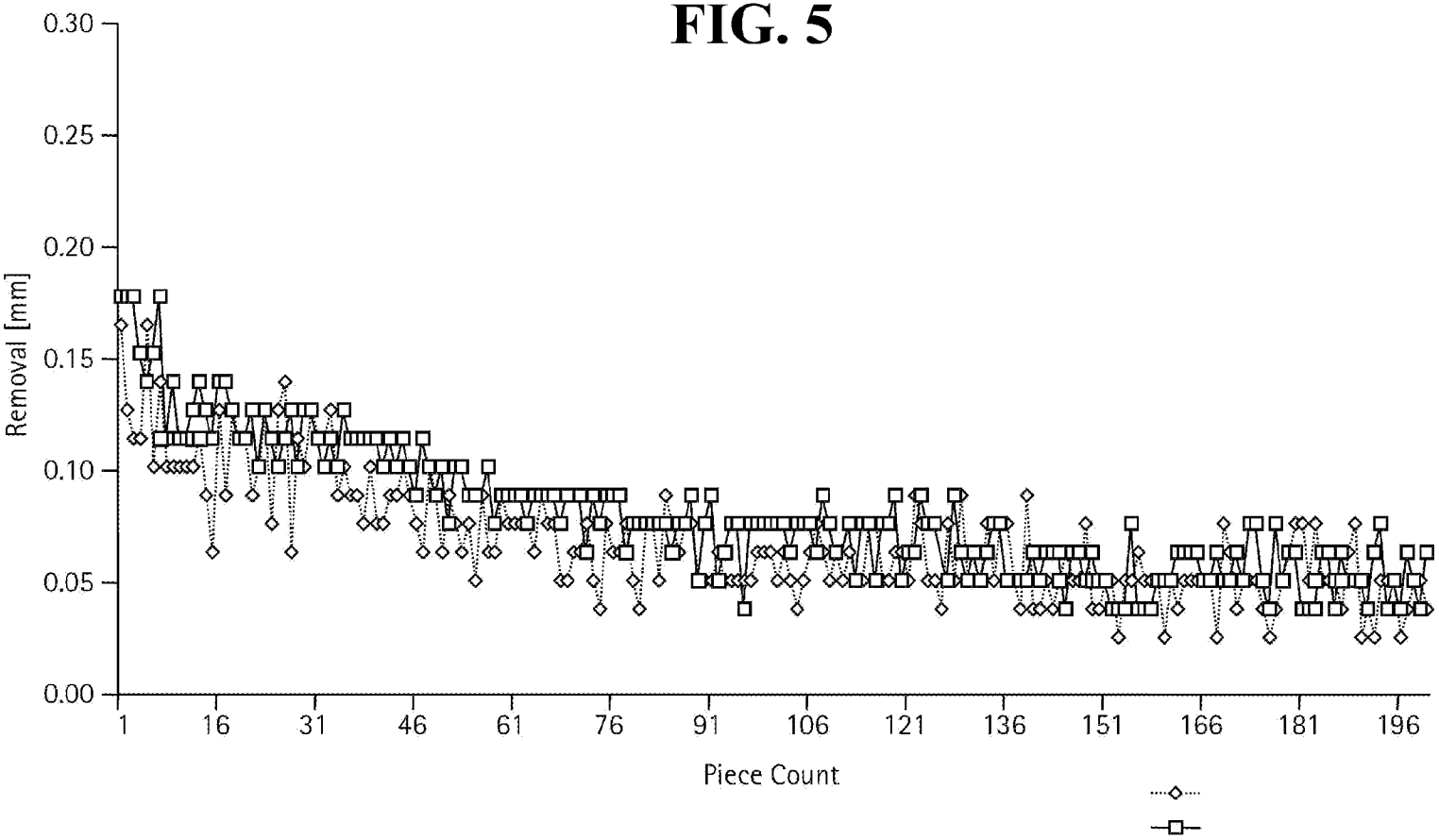
FIG. 5 is a chart showing the effects of wheel aging on material removal.

Referring to FIG. 5, a chart showing the effects of the grinding wheel 34 aging on material removal is disclosed. In this experiment, a 3.5N force is applied to the substrate edge.

Each starting point was begun with a freshly stick dressed grinding wheel 34. Subsequently, almost 200 glass substrates 207 were finished. Initially, the system 10 removes, on average, about 150 microns of material. At the end of the run, the amount of material removed is in the 50 micron range. Experimental testing was conducted using a 150 diameter 600 grit grinding wheel 34 to determine if any differences or advantages could be achieved using a finer diamond mesh relative to conventional production capabilities.

Experiments have also shown that as the grinding wheel 34 ages, the friction of the grinding wheel 34 mesh decreases, resulting in a decrease in the tangential force component. Thus, as might be expected, the applied normal load should be increased during the course of the run to compensate for the decreased friction (tangential load).

Grit size may also play a factor in the surface roughness as the grinding wheel 34 ages. There is a slight improvement in the edges produced by the present invention using a 450 grit grinding wheel 34 relative the edge roughness of glass substrates 207 finished using conventional systems. There was a significant improvement seen when using a 600 grit grinding wheel 34 with the present invention. When the 450 grit grinding wheel 34 is used, roughness decreases as the number of units produced increases. Initially, surface roughness is in a range between 0.7-0.9 microns. At the end of the run (piece count=200), the roughness is in the 0.5-0.6 micron range. When a 600 grit grinding wheel 34 is employed in system 10, the surface roughness remains relatively stable (0.4-0.6 microns).

It is also noted that 600 grit grinding wheels 34 result in superior interfaces relative to 450 grit grinding wheels 34. The interface is the location where the ground edge meets the major surface of the glass substrate 207. 600 grit grinding wheels 34 provide smoother interfaces. A smoother interface improves a glass substrate's structural integrity and results in a stronger glass substrate 207. Thus, the glass substrate 207 having a smoother interface is more likely to avoid breakage during subsequent processing steps.

Figure 6:
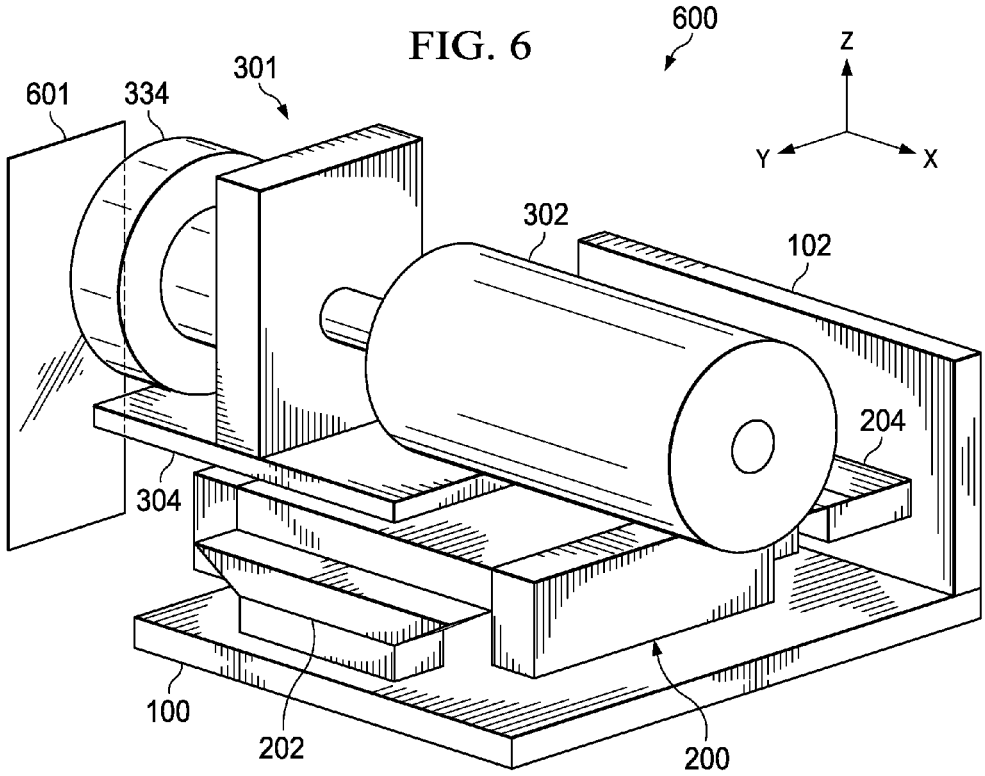
FIG. 6 is a perspective view of the pressure feed grinding system in accordance with the present invention.

As embodied herein and depicted in FIG. 6, a perspective view of the "Linear" pressure feed grinding system 600 in accordance with the present invention is disclosed. System 600 includes air bearing slide 200 coupled to grinding unit 301. Air bearing slide 200 is configured to glide over rail member 202. Rail member 202 is disposed on support bracket 100. Air bearing slide 200 is moved along the y-axis by a linear actuation motor 204. Linear actuation motor 204 is mounted to end-plate 102. Grinder support member 304 is connected to air bearing slide 200. Spindle motor 302 is fixed to, and supported by, grinder support member 304. Spindle motor 302 is configured to drive grinding wheel 334 (note: the spindle motor 302 and grinding wheel 334 may be part of what is referred to herein as a grinding device). Linear actuation motor 204 includes a drive linkage (not shown) that moves air bearing slide 200 along the y-axis. In particular, linear actuation motor 204 is configured to move the air bearing slide 200 in the y-axis direction to thereby position grinding wheel 334 against the glass substrate 601 such that a predetermined force is applied to the glass edge in a direction that is normal thereto. A vacuum chuck (not shown), disposed proximate to the grinding wheel 334, is configured to hold the glass substrate 601 in three-dimensional alignment relative to grinding wheel 334. The present invention has been employed to finish glass substrates 601 having dimensions greater than or equal to 1.5 m×1.3 m×0.7 mm.

During an edge finishing operation, linear actuation motor 204 positions grinding wheel 334 at the appropriate position on the y-axis and the vacuum chuck moves the glass edge along the z-axis. An alternative method holds the glass substrate 601 stationary and moves the grinding unit 301 in an axis along the edge of glass substrate 601 being finished. System 600 also provides a coolant nozzle (not shown) at the location where grinding wheel 334 interfaces the vacuum chuck and the glass substrate 601 to manage the heat generated by the grinding/polishing operations. The vacuum chuck and conveyance system employed during this operation may be similar to the system/chuck employed in the embodiments discussed above (See FIG. 1 and FIG. 2).

The linear air bearing slide 200 may be of any suitable type, as long as there is substantially zero frictional resistance as glide member 200 travels along rail member 202. In one embodiment, the air bearing slide 200 is of a type manufactured by New Way Machine Components, Inc. In the present invention, the air bearing slide 200 is supported by a thin film of pressurized air that provides a zero friction load bearing interface between the air bearing slide 200 and rail member 202. The thin film air bearing is generated by supplying a flow of air through the bearing itself to the bearing surface. Unlike traditional 'orifice' air bearings, the air bearing of the present invention delivers air through a porous medium to ensure uniform pressure across the entire bearing area. Although the air constantly dissipates from the bearing site, the continual flow of pressurized air through the bearing is sufficient to support the working loads. Again, because there is no contact between the air bearing slide 200 and rail member 202, traditional bearing-related problems of friction, wear, and lubricant handling are eliminated. Further, because of the "stiffness" and stability of the air bearing slide 200, and the precision of linear actuation motor 204, precision loading is achievable.

By mounting the grinder support member 304 to the air bearing slide 200, a heavier spindle motor 302 may be employed. This conveniently allows the designer to employ an "off-the-shelf" spindle motor package. In one embodiment of the present invention, the spindle motor 302 operates the grinding wheel 334 at 7,500 surface-feet per minute.

In one embodiment, the linear actuation motor 204 may be manufactured by Systems, Machines, Automation Components Corporation. However, it will be apparent to those of ordinary skill in the pertinent art that modifications and variations can be made to the linear actuation motor 204 of the present invention depending on the size, weight, force, and positioning precision. For example, the linear actuation motor 204 may be a voice coil motor. As those of ordinary skill in the art will appreciate, a voice coil motor is an electromagnetic positioning motor. During operation, electrical current is applied to the winding of an electromagnetic coil to generate a magnetic field around the coil. The generated magnetic field around the coil interacts with the permanent magnetic field in the actuator. The permanent magnetic field is generated by a magnet disposed in the actuator. The interaction generates a force which moves the coil. The magnitude and direction of the force is manipulated by the selective application of current. The force imparts a reciprocating motion to the actuator. The reciprocating force is transmitted to a linkage, such as a rod, to thereby move air bearing slide 200 along the y-axis. In one embodiment, the linear actuation motor 204 may apply a peak force of up to 65 N, and a continuous force of up to 42 N. The voltage applied to the linear actuation motor 204 may be 24V or 48V.

The embodiment of FIG. 6 may be characterized by a smaller footprint (18"×15") and reduced weight (Approximately 250 Lbs.) when compared with the embodiment given in FIG. 1. The use of the linear actuation motor 204, such as a voice coil, also provides for an accurate control of the velocity of the air bearing slide 200. The linear actuation motor 204 of the present invention includes a closed loop feedback control that accurately applies a predetermined force to the edge of the glass substrate 601 in a substantially constant way. The linear actuation motor 204 is also programmed to compensate for the wear associated with the diamond grind wheel 334. As those of ordinary skill in the art will appreciate, as the grinding wheel 334 becomes dull, the normal force applied to the glass edge must increase to obtain a uniform finish.

It will be apparent to those skilled in the art that various modifications and variations can be made to the present invention without departing from the spirit and scope of the invention. Thus, it is intended that the present invention cover the modifications and variations of this invention provided they come within the scope of the appended claims and their equivalents.

What is claimed is:

1. An apparatus for grinding or polishing at least one edge of a glass substrate, the apparatus comprising:

a grinding unit configured to remove a predetermined amount of material from the at least one edge when in an aligned position with respect to the glass substrate;

an air bearing slide system coupled to the grinding unit, the air bearing slide system being configured to slide along a predetermined axis on a thin film of pressurized air that provides a zero friction load bearing interface; and a linear actuation motor coupled to the air bearing slide system, the linear actuation motor being configured to control the movement of the air bearing slide system such that the grinding unit is moved from a non-aligned position with respect to the glass substrate to the aligned position with respect to the glass substrate, whereby the grinding unit applies a predetermined force normal to the at least one edge, the predetermined force being directly proportional to the predetermined amount and less than a normal force resulting in glass substrate breakage.

2. The apparatus of claim 1, wherein the air bearing slide member further comprises:

a pressurized air unit configured to provide a continual flow of pressurized air;

a rail member coupled to the pressurized air unit, the rail member including a porous medium configured to provide the thin film of pressurized air, the thin film of air being of substantially uniform pressure;

a slide member disposed over the rail member, the slide member configured to support the grinding unit, the thin film separating the slide member and the rail member during a grinding operation.

3. The apparatus of claim 2, further comprising a support bracket connected to the slide member, the support bracket also being configured to support the grinding unit.

4. The apparatus of claim 1, wherein the grinding unit further comprises:

a support bracket coupled to the air bearing slide system, the support bracket being disposed on a bearing area of the air bearing slide system;

a grinding device connected to and supported by the support bracket, the grinding device being configured to grind or polish the at least one edge.

5. The apparatus of claim 4, wherein the support bracket is an L-bracket.

6. The apparatus of claim 4, wherein the grinding device further comprises a spindle motor supportingly connected to the support bracket; and a grinding wheel operatively coupled to the spindle motor, the grinding wheel being driven by the spindle motor to operate at a predetermined rate.

7. The apparatus of claim 6, wherein the grinding wheel is a 450 grit grinding wheel.

8. The apparatus of claim 6, wherein the grinding wheel is a 600 grit grinding wheel.

9. The apparatus of claim 8, wherein the spindle motor operates the grinding wheel at 7,500 surface-feet per minute.

10. The apparatus of claim 8, wherein the predetermined force is substantially within the range of 1N-6N, and the predetermined amount is substantially within the range of 25 microns-150 microns.

11. The apparatus of claim 10, wherein the predetermined force is substantially equal to 4N and the predetermined amount of material removed from the edge is substantially equal to 100 microns.

12. The apparatus of claim 6, wherein the linear actuation motor is programmed to vary the predetermined normal force in accordance with grinding wheel wear.

13. The apparatus of claim 1, further comprising a conveyor unit disposed proximate the grinding unit, the conveyor unit being configured to support the glass substrate, and move the glass substrate in a tangential direction relative to the grinding unit during grinding and/or polishing process steps.

14. The apparatus of claim 13, wherein the conveyor system further comprises:

a vacuum chuck for holding the glass substrate in a fixed position during the grinding and/or polishing process steps;

a conveyor coupled to the vacuum chuck, the conveyor being configured to move the vacuum chuck in a linear direction relative to the grinding unit at a predetermined rate or conversely the grinding unit may be moved relative to the vacuum chuck; and a coolant mechanism disposed proximate an interface of the grinding unit and the at least one edge.

15. The apparatus of claim 1, wherein a width of the predetermined amount of material removed from the at least one edge is uniform.

* * * * *